US005662054A

United States Patent [19]

Bardsley

[11] Patent Number: 5,662,054

[45] Date of Patent: Sep. 2, 1997

[54] YARN FAULT DETECTION FOR TUFTING MACHINES

[75] Inventor: Harold Brian Bardsley, Nr. Chorley, England

[73] Assignee: Spencer Wright Industries, Inc., Dalton, Ga.

[21] Appl. No.: 593,942

[22] Filed: Jan. 30, 1996

[30] Foreign Application Priority Data

Feb. 16, 1995 [GB] United Kingdom ..... 9503001

[51] Int. Cl.[6] ..... D05C 15/08; D05C 15/20

[52] U.S. Cl. ..... 112/80.18; 112/278; 112/80.43; 112/470.01

[58] Field of Search ..... 112/80.43, 80.18, 112/221, 273, 278, 80.01, 470.01; 200/61.13, 61.18

[56] References Cited

U.S. PATENT DOCUMENTS 3,352,267 11/1967 Brandriff et al. ..... 112/278
3,843,883 10/1974 De Vita et al. ..... 112/273 X
4,186,672 2/1980 Burton ..... 112/273
4,970,974 11/1990 Price ..... 112/80.18
5,392,723 2/1995 Kaju ..... 112/80.43 X

*Primary Examiner*—Paul C. Lewis
*Attorney, Agent, or Firm*—Alan Ruderman

[57] ABSTRACT

A controlled needle tufting machine has a cyclically reciprocating latch bar to which the needles may be selectively latched in accordance with a pattern to reciprocate and insert loops of yarn into a backing material or to not be latched and remain stationary above the backing material includes yarn detection apparatus for determining whether the feeding of yarn for the needle is correct. The detection apparatus includes a yarn fault detector for detecting whether yarn is moving between a source and a respective needle and for providing a signal in response to such movement. The yarn movement signal is compared with a signal from the pattern control and if the needle is latched and yarn is supposed to be moving, a fault signal is provided if the yarn is not moving. If the needle is supposed to be stationary but the detector indicates that yarn is moving, a fault signal may also be provided. In either case the fault signal is displayed and the machine may be stopped. An optical detector is disclosed for detecting yarn moving through a bore in a body member within which the optical detector is mounted.

14 Claims, 3 Drawing Sheets

YARN FAULT DETECTION FOR TUFTING MACHINES

BACKGROUND OF THE INVENTION

This invention relates to tufting machines and more particularly to a yarn feed system having a fault detector for stopping the tufting machine when the feeding of the yarn does not conform to that called for by a pattern controller.

In tufting machines, a plurality of yarn carrying needles are mounted on one or more needle bars extending transversely across the machine and reciprocated cyclically to penetrate and insert loops of yarn into a backing material moving longitudinally beneath the needles. The loops thus formed are seized either by loopers or hooks mounted on a hook bar and either shed or held and thereafter cut depending upon whether it is desired to produce loop or cut pile in the material. When a substantial amount of versatility in patterning in the tufted fabric is desired, it is known to provide each needle with a sew/no-sew capability by mounting the needles on individual needle carriers which are reciprocated selectively in accordance with a pattern by either being latched to or disengaged from a reciprocating latch bar, the latch bar being reciprocably driven continuously from mechanism driven by a rotating main shaft mounted in the head of the tufting machine. When latched to the latch bar, the needle carrier and the respective needle or needles reciprocate into cooperation with the hook or looper to form a loop which is thereafter cut. The latching occurs by means of latch pins on pneumatic cylinders driven in accordance with a pattern. Machines of this type are known as controlled needle machines, and when each needle is individually controlled in this manner, it is known as an individual controlled needle machine. Examples of such machines are illustrated in U.S. Pat. Nos. 3,115,856; 3,259,088; 3,881,432 and 3,986,465.

A problem encountered in relation to machines of this type may occur if the feed of yarn to one or more needles is not correct, for example, either the yarn required is not being fed to a particular needle or if a yarn is being fed when one is not called for due to a failure in the yarn feed system. If, there is a yarn breakage, unthreading of the yarn from a needle or exhaustion of the supply of yarn from which the yarn is fed, it may not normally be possible to detect such fault conditions to prevent errors in forming the tufted fabric. In some cases a yarn may be picked up by an adjacent needle, and in the case of an individually controlled needle machine if a needle is latched, a yarn end that has been cut may extend into the backing which may grab and pull the yarn past the yarn clamp from the creel. Thus, a reduction in quality of the finished tufted fabric or the production of commercially useless finished fabric may occur in these cases.

The known fault detection devices sense whether any yarn being fed to the eye of any needle has either broken or unthreaded, i.e., whether yarn if being fed. Since these devices have been associated solely with tufting machines wherein all yarns are to be fed continuously to every needle, they have no applications to a controlled needle machine as described above since they would provide a false reading when a needle which is not being fed with yarn is not supposed to be fed with yarn. Examples of the known yarn break detectors/stop motion devices of this type include U.S. Pat. Nos. 3,529,560; 3,764,773; 5,687,095; 4,522,139 and 5,005,503.

SUMMARY OF THE INVENTION

Consequently, it is a primary object of the present invention to provide a yarn feed fault detector which may sense when a fault in the feeding of yarn to any particular needle of a controlled needle tufting machine occurs.

It is another object of the present invention to provide in a tufting machine having a plurality of yarns selectively fed to respective needles in accordance with a pattern, yarn fault dector apparatus providing signals indicative of a fault in the feeding of a yarn.

It is a further object of the present invention to provide a yarn fault detector for a tufting machine having needles selectively operable to penetrate a backing material in accordance with a pattern, the fault detector having control means associated therewith for determining whether any particular needle is being fed as required.

It is a still further object of the present invention to provide a yarn fault detector for a tufting machine having needles selectively operable to penetrate a backing in accordance with a pattern, the fault detector having control means associated therewith for determining whether the feeding of yarn to any particular needle is not in accordance with that called for by the control.

Accordingly, the present invention provides a yarn feed system for feeding yarn from a supply to the needles of a controlled needle tufting machine, the feed system having fault detection apparatus which is operable to detect a fault in the yarn feed to one or more of the needles from the supply, the apparatus preferably including a detector placed in the path of the yarn from the supply to detect the yarn requirements of one or more needles in the machine, and preferably in the path of the yarn to each needle. For example, a single detector may detect the yarn requirements for an amount of ten or twenty needles, or alternatively, a separate detector may be provided to detect the yarn requirements of each needle. Preferably the fault detection apparatus, upon detection of a fault, is operable to cause the tufting machine to stop. Each detector may provide a signal indicative of the detection of a fault and indicative of non-detection of a fault and the detector may be coupled to a visual display. More than one detector may be linked to a single display, and preferably all the detectors may be linked to a single display operable to visually show the detection or non-detection of a fault indication in yarn fed to each needle of the machine.

Preferably the fault detection apparatus comprises an optical detector which detects whether the yarn passing therethrough is moving or stationary. Each detector may be linked to a central control which includes a suitable display, the control being operable to receive the fault indication signals from the detector and provide one or more displays thereof. The control may be adapted to store information relating to the production of pre-determined patterns, and may also be operatively linked to control the latching and unlatching of the needles for the patterns. The signals provided to effect latching and unlatching of the needles to cause them to produce the desired pattern preferably is compared with the signal produced by the detector to ensure that the selected pattern is being produced correctly and accurately by the machine. Preferably, the control includes a microprocessor or computer which may incorporate a visual display unit.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
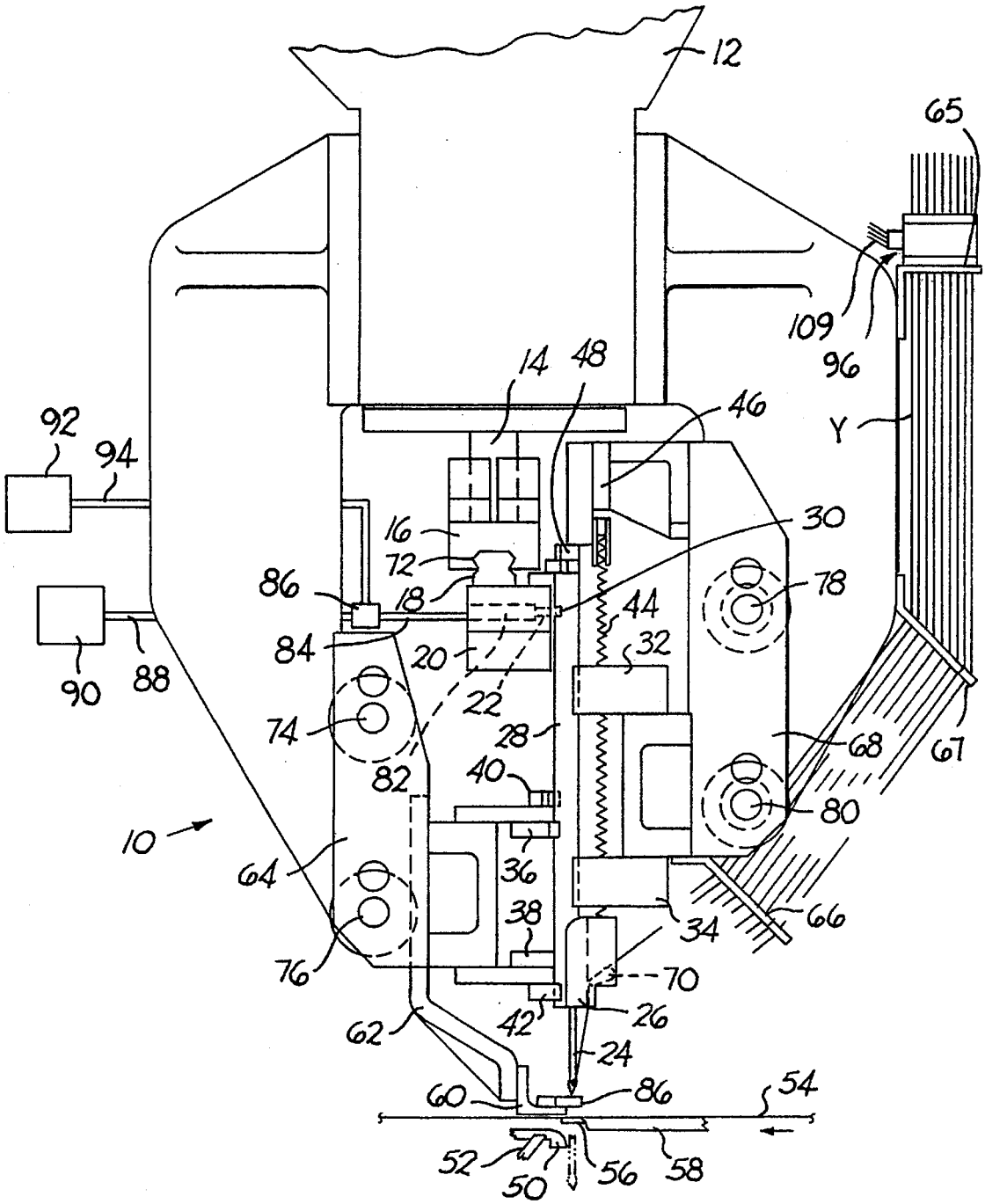
FIG. 1 is a fragmentary side elevational view of a tufting machine incorporating a yarn fault detector constructed in accordance with the principles of the present invention.

Referring to the drawings, FIG. 1 illustrates a tufting machine 10 incorporating apparatus constructed in accordance with the principles of the present invention. The machine includes a laterally elongated head 12 within which a plurality of laterally spaced push rods 14 are mounted for reciprocation, only one of the push rods being illustrated. Clamped about the push rods 14 for reciprocation therewith is a laterally elongated push rod foot 16. Depending upon the lateral length of the tufting machine and the number of push rods, there may be a number of such push rod feet across the machine reciprocating in synchronism. The lower end of each push rod foot 16 is connected by a connecting member 18 to a latch bar 20 which has a multiplicity of air cylinder actuated latch pins 22 which may be selectively extended from or retracted into the latch bar in accordance with a pattern in a manner well known in the art. Such a tufting machine is known in the art as a controlled needle tufting machine.

Preferably the controlled needle tufting machine incorporates a separately controlled latch pin 22 corresponding to each tufting needle 24 in the machine, and thus is known as an individually controlled needle tufting machine. This is the environment of the present invention. Thus, each needle 24 is mounted within and extends from a separate needle holder or mounting bar 26 secured to the lower or distal end of a needle carrier 28, the needle carrier 28 being in the form of a thin vertically elongated bar. Adjacent the upper end of the needle carrier is a slot 30 adapted to receive the corresponding latch pin 20. When the latch pin is extended into the Slot 30 of the needle carrier 28 associated with a particular needle 24, the needle carrier and thus the needle is reciprocably driven with the latch bar 20 and the push rods 14. Each needle carrier 28 is guided within respective guide channels in guide blocks 32, 34 and 36, 38, 40, 42 at respective edges of the carrier so that the carrier may reciprocate readily in the guide channels.

When the latch pin 22 is retracted out of the slot 30 into the latch bar 20, the needle carrier 28 and thus the needle 24 associated with that latch pin is no longer driven; it is rendered inactive. A coil spring 44 having its upper end attached to a frame member 46 extends through the guide blocks 32, 34 and is attached to the top of the needle mounting bar 26. When the latch pin 22 is not engaged in the slot in the needle carrier, the spring 44 urges the mounting bar 26, and thus the needle 24 and carrier upwardly toward the head 12, the upper end of the needle carrier being held stationary against an abutment member 48 on the frame member 46 adjacent the upper end of the spring.

Mounted in the bed of the tufting machine is a hook 50 conventionally oscillated into and out of cooperation with the needle 24 to seize and hold loops of yarn when the needle is reciprocated or active, the hook having its free end pointing in the direction opposite to that in which the backing 54 is fed. An oscillating knife 52 operating in scissors-like fashion with the hook acts to cut the loops of yarn on the hook. The backing material 54 is fed by feed rollers (not illustrated) in the direction of the arrow over a plurality or comb of spaced needle plate fingers 56 carried by a bed plate 58 so that when the needle reciprocates, the loops which are seized by the hook project from the face of the backing material and backstitches are formed on the backside or upper surface of the backing material. A presser foot 60 is mounted on a bracket 62 carried by a frame member 64 for engaging the upper or backstitch surface of the backing material to prevent the backing from following the needles so the needles reciprocate upwardly out of the backing as well known in the art. Additionally, a yarn strand Y for each needle is fed through yarn guides 65, 66, 67, at least one of the guides 66 being secured to a frame member 68 to which the frame member 64 is also secured. A spring biased yarn clamp member 70 pivotably mounted on each mounting bar 26 clamps the respective yarn strand, and as the needle moves downwardly pulls yarn from a yarn source such as a creel (not illustrated) so that yarn is available for the subsequent stitch. On the return stroke of the needle, the clamp 70 rides over the yarn as the loop of yarn formed is tightened about the hook 50. Thus, yarn is effectively fed only when the needle is actively moving.

The individually controlled needle tufting machine 10 illustrated in the drawings also has the feature of shifting the needles laterally so that unique patterns may be produced when such feature is combined with an intermittent backing feed system and yarns of different color or the like are fed to the individual needles. Thus, the connecting member 18 is mounted within a dove-tail bearing slideway 72 in the push bar foot 16 so that the latch bar 20 may be shifted laterally. Additionally, the frame members 64 and 68 are supported by linear bearing slides 74, 76 and 78, 80 respectively so that the presser foot 60 and the guide blocks 36, 38, 40, 42 may be shifted laterally as are the guide blocks 32, 34, the frame member 46, the yarn guide 66, and the needle mounting bar 26 and needle carrier 28 even when not latched to the latch bar 20.

Each latch pin 22 is formed on or otherwise connected to the end of a respective air cylinder 82 and, as aforesaid, is actuated thereby. Each air cylinder 82 communicates through a conduit 84 to a respective electrically controlled pneumatic valve 86 which further communicates through conduits 88 with a single source of pressurized air such as compressor 90. The valves 86 are electrically connected to a pattern control 92 through electrical leads or the like 94, the pattern control 92 preferably being a computer control system loaded with pattern information from, for example, a floppy disk or the like prepared on a separate pattern generation system. Consequently, as determined by the pattern control 92 each valve 86 individually and selectively may permit air to flow from the compressor to the respective cylinder 82 to extend the latch pin 22, or vent the valve, the valve pin 22 preferably being biased to the retracted position so that when pressurized air is not supplied to the cylinder 82, the pin is not extended.

Figure 2:
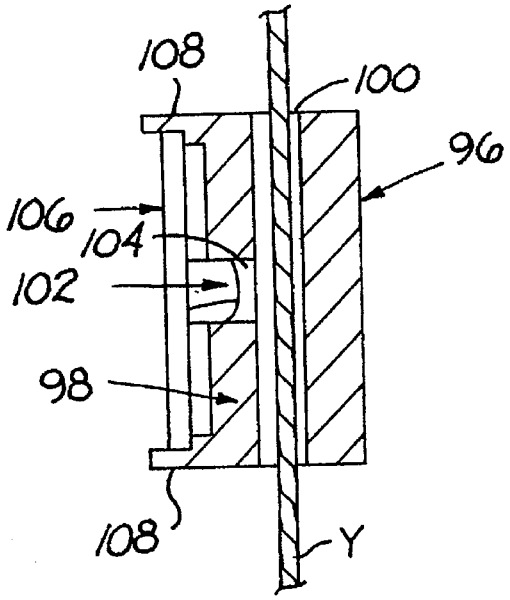
FIG. 2 is an enlarged sectional view of a detector shown in FIG. 1.

In accordance with the present invention, detection apparatus 96 is positioned directly in the feed path of the yarn from the supply or creel to the needles. As illustrated in FIG. 2, the detection apparatus 96 comprises a body 98 having a through bore 100 through which the yarn from the supply passes. A detector 102 is mounted in a recess 104 in a wall of the body 98, the recess 104 opening out into the bore 100. The detector 102 is connected to control circuitry 106 which may be conveniently mounted on a printed circuit board mounted behind the detector 102 and held in position between two rearwardly extending arms 108 of the body 98. As hereinafter explained, the control circuitry may include a microprocessor or merely an electronic gate. In the embodiment shown, the detector 102 comprises an optical detector which detects movement of the yarn, although it may be appreciated that any suitable form of detector which determines movement of the yarn may be used as desired or as appropriate. As an alternative to the arrangement shown in FIG. 2, the control circuitry may be mounted remote from the body 98 or the detector 102 while remaining electrically connected thereto.

Figure 3:
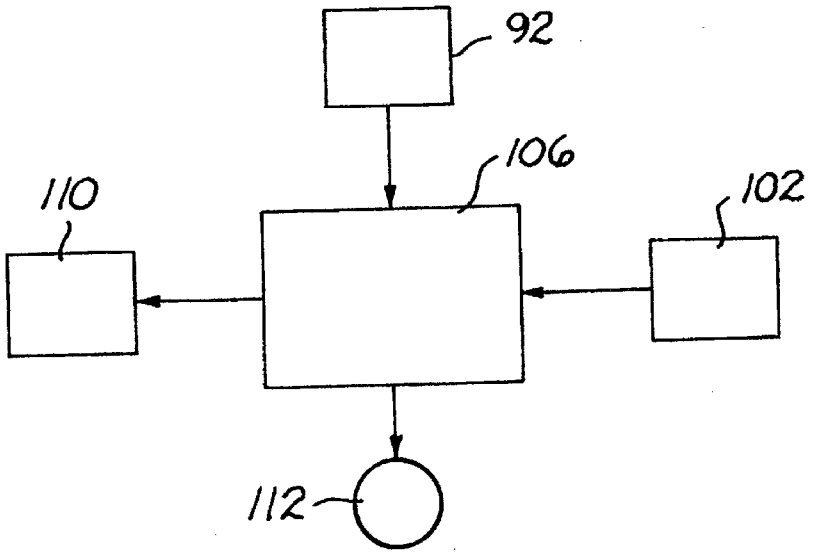
FIG. 3 is a block diagram illustrating the control comparing the signals from the pattern and the detector.

The control circuitry 106 is connected through electrical leads 109 to the pattern control computer 92 which, as illustrated in FIG. 3, may transmit control signals to the control circuitry 106 which also receives signals from the detector 102. The signals sent by the computer 92 to the circuitry 106 includes the pattern information relating to whether the particular needle is to be latched and driven or inoperative and stationary during any particular stitch, and thus whether yarn is to be fed and moving or not fed and stationary for that particular needle. The signals received from the detector may preferably be displayed on a suitable display 110. As illustrated in FIG. 3, the information from the pattern control computer 92 and the detector 102 may be processed by the control circuitry 106 to provide an error signal to a stop control 112 to stop the tufting machine when a yarn feed error exists.

In use, in the operation of the tufting machine yarn Y is fed by being pulled from the supply or creel through the bore 100 of the detection apparatus 96 and to the respective needle 24 of the machine as the needle is driven downwardly. Movement of the yarn through the bore 100 is detected by the detector 102 and a signal is fed to the control circuitry 106 indicating that the yarn is moving or is stationary. In the embodiment illustrated, a single detector 102 may be used to detect the movement of a number of yarns Y and a number of detectors may be provided, each detecting movement of a number of yarns or alternatively, a separate detector may be provided for each yarn Y.

Figure 4:
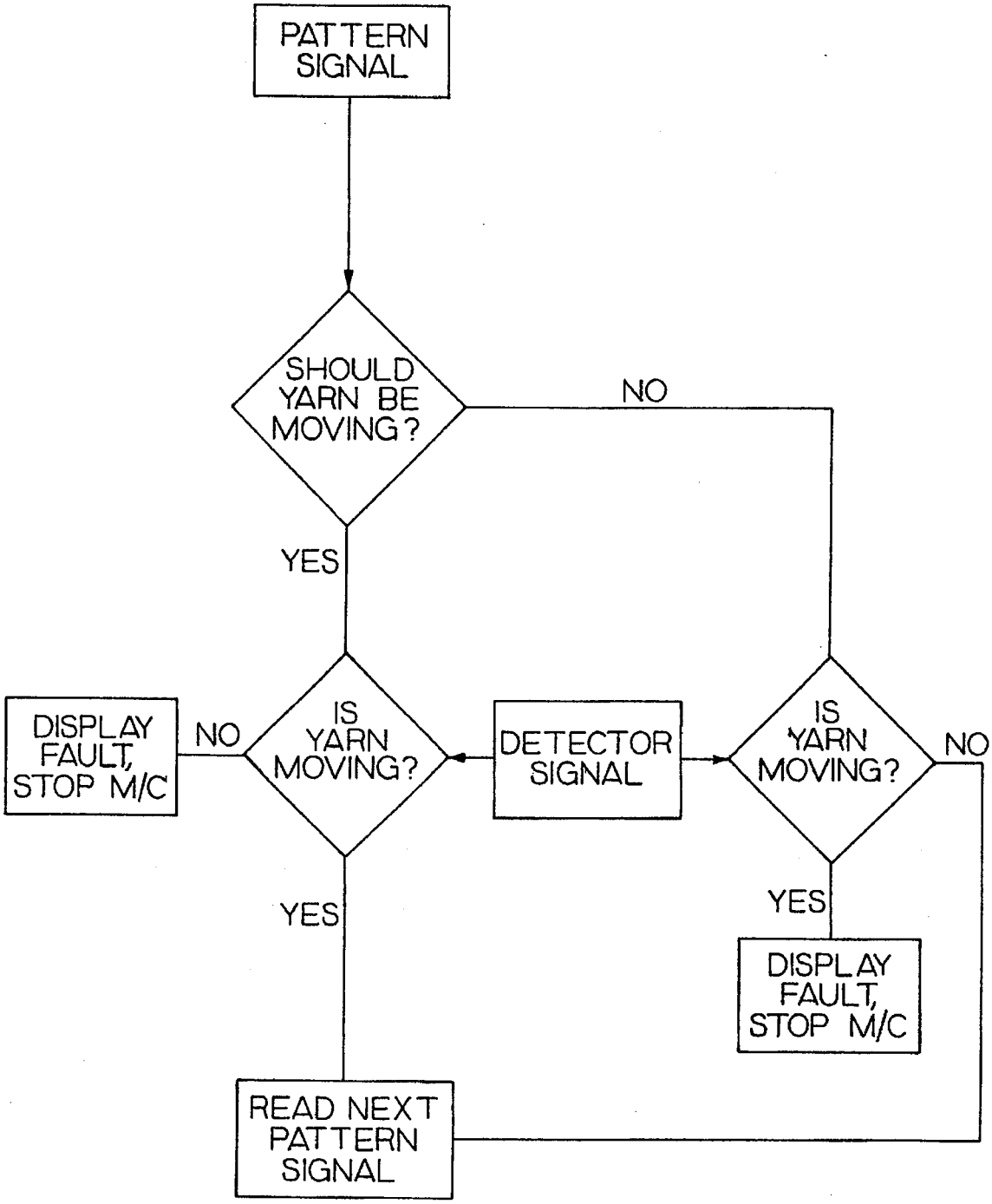
FIG. 4 is a flow diagram for a program for the control.

The control circuitry may merely be an electronic gate for each yarn end such as an Exclusive OR Gate, the truth table for which presents an error signal only when the pattern control calls for yarn to be fed but no yarn movement is being detected, or when the pattern control does not call for yarn to be fed but movement of yarn is being detected. If the detector signal and the pattern control signal correspond, then there is no error. Such a gate may be a quad Exclusive OR Gate, such as that manufactured by Motorola Corporation as Model No. MC 14070B. In that case one gate may be connected to four detectors for four respective needles. Alternatively, the control circuitry 106 may include any simple microprocessor, i.e., computer chip, which may be programmed in accordance with the flow diagram illustrated in FIG. 4 for each yarn end. Thus, pattern information from the computer 92 is fed to the microprocessor as to whether the particular needle is to be moving, i.e., whether yarn should be or not be fed or moving for that needle. If yarn is to be fed, the signal is compared with that of the detector to determine if the yarn is or is not moving through the detector. If yarn is being fed and is thus moving, the yarn feed system is properly operating. If yarn is not moving, a fault signal is generated, displayed as a fault and preferably may be used to stop the tufting machine. Additionally, if the pattern calls for a needle to be inoperative so that yarn is not being pulled by the needle, i.e., the yarn is supposed to be stationary for that cycle of the machine, then the control signal is compared to the signal from the detector and if the yarn is not moving the yarn feed system is operating correctly, but if the yarn is moving a fault is determined. The fault is displayed and the machine may be stopped. If a fault is detected in either case, the display preferably identifies the particular detector or needle effected and may also sound an alarm. The tufting machine operator may then take remedial action to correct the fault.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a cyclically reciprocating bar and a plurality of needles, each needle being selectively latched to said bar in accordance with a pattern to reciprocate with said bar to insert loops of yarn into a base material and when not latched to said bar to be stationary above said base material, and means for feeding yarn from a source to each needle only when said needle is reciprocating, yarn fault detection apparatus comprising, a detector for sensing movement of yarn to a particular needle and for providing a signal indicative of movement and non-movement of said yarn, circuit means for receiving a pattern information signal corresponding to each cycle of said bar indicative of whether said particular needle is latched to said bar and reciprocating therewith or is-not latched and is stationary, and control means associated with said circuit means and said detector for comparing said pattern information signal with the signal provided by said detector to determine whether or not yarn is being fed to said particular needle when said needle is reciprocating and for providing a fault signal when said yarn is not being fed.

2. In a tufting machine as recited in claim 1, including means for displaying said fault signal.

3. In a tufting machine as recited in claim 2, including means for stopping said machine When a fault signal is provided.

4. In a tufting machine as recited in claim 1, wherein said control means further compares said pattern information with the signal provided by said detector to determine whether or not yarn is being fed to said particular needle when said needle is stationary and for providing a fault signal when said yarn is being fed.

5. In a tufting machine as recited in claim 4, including means for displaying said fault signal.

6. In a tufting machine as recited in claim 5, including means for stopping said machine when a fault signal is provided.

7. In a tufting machine as recited in claim 1, wherein said detection apparatus comprises a body member having a bore extending therethrough for passage of yarn, said detector being disposed in said body member adjacent said bore for sensing movement of yarn through said bore.

8. In a tufting machine as recited in claim 7, wherein said detector optically senses said yarn movement.

9. A method for determining a yarn feeding fault during the operation of a tufting machine having a needle selectively latched to a cyclically reciprocating bar to reciprocate with said bar or to remain stationary during any particular cycle in accordance with a pattern, said method comprising determining whether said pattern calls for said needle to be operative or stationary during said cycle, detecting whether yarn is moving in a path between a yarn supply and said needle, and providing a fault signal when said needle is Operative but yarn is not moving in said path.

10. In the method as recited in claim 9, including displaying a representation of said fault signal.

11. In the method as recited in claim 10, including stopping said machine in response to said fault signal.

12. In the method as recited in claim 9, including providing a fault signal when a needle is stationary but yarn is moving in said path.

13. In the method as recited in claim 12, including displaying an indication of a fault when there is a fault signal.

14. In the method as recited in claim 12, including stopping said machine in response to a fault signal.

* * * * *